United States Patent [19]

Dziubakowski et al.

[11] Patent Number: 4,900,232

[45] Date of Patent: Feb. 13, 1990

[54] COMPRESSOR SURGE CONTROL METHOD

[75] Inventors: Donald J. Dziubakowski, Seven Hills; Marion A. Keyes, IV, Chagrin Falls; Jeremiah J. Shaffer, Mentor, all of Ohio

[73] Assignee: The Babcock & Wilcox Company, New Orleans, La.

[21] Appl. No.: 324,492

[22] Filed: Mar. 16, 1989

Related U.S. Application Data

[60] Division of Ser. No. 192.807, May 11, 1988, Pat. No. 4,861,233, which is a continuation of Ser. No. 539,773, Oct. 7, 1983, abandoned.

[51] Int. Cl.[4] ..... F04B 27/02

[52] U.S. Cl. ..... 417/53; 417/201

[58] Field of Search ..... 415/1, 11, 26, 27, 28; 417/53, 199.1, 201, 202, 282

[56] References Cited

U.S. PATENT DOCUMENTS

| | | | |
|---|---|---|---|
| 4,139,328 | 2/1979 | Kuper et al. | 415/27 |
| 4,203,701 | 5/1980 | Abbey | 415/11 |
| 4,380,893 | 4/1983 | Stokes et al. | 415/27 |
| 4,464,720 | 8/1984 | Agarwal | 415/11 |
| 4,627,788 | 12/1986 | Keyes et al. | 415/27 |

OTHER PUBLICATIONS

Staroselsky et al., "Improved Surge Control For Centrifugal Compressors"; Chemical Engineering; May, 1979.

*Primary Examiner*—Louis J. Casaregola

*Attorney, Agent, or Firm*—Vytas R. Matas; Robert J. Edwards

[57] ABSTRACT

A surge control system (16) is provided for a compressor (14) which anticipates the actual surge condition and initiates anti-surge protection in proportion to the magnitude of the anticipated surge condition. This is done by providing a feed forward signal (20) to a summing station (48) along with a normally generated surge control line point (44) to offset this point (44) by an amount determined by the feed forward signal (20). This offset point (50) is used as an input to a controller for controlling the bypass valve (28) in a bypass loop (30) around the compressor (14).

3 Claims, 2 Drawing Sheets

COMPRESSOR SURGE CONTROL METHOD

This is a division of application Ser. No. 192,807 filed May 1, 1988, (now U.S. Pat. No. 4,861,233) which is a continuation of application Ser. No. 539,773, filed Oct. 7, 1983, abandoned.

TECHNICAL FIELD

The present invention relates to compressor surge controls generally and in particular to surge controls having a feed forward signal to anticipate such a surge condition.

BACKGROUND ART

Surge conditions occur in a centrifugal compressor when the inlet flow is reduced to the extent that the compressor, at a given speed, can no longer pump against the existing pressure head. At this point, a momentary reversal of flow occurs along with a drop in pressure head. Normal compression resumes and the cycle repeats. This causes a pulsation and shock to the entire compressor and piping arrangement. If left uncontrolled, damage and danger to the compressor could result.

All centrifugal compressors are supplied with characteristic and setpoint curves defining the zones of operation for the compressor. These compressors "maps" illustrate the surge are and the "stonewall" area or pumping limit of the turbomachinery. As shown in FIG. 1*a*, the surge limit line is plotted against a discharge pressure versus flow rate relationship. Taking into account no changes in speed, flow, pressure, or inlet gas temperature the surge control line can be plotted with this equation.

$$\text{SURGE CONTROL LINE} = \qquad \text{(EQ. 1)}$$

$$\%\ \text{OF CONTROL MARGIN DESIRED} \times \frac{\Delta P \text{ ACROSS COMPRESSOR}}{\Delta P \text{ ACROSS INLET ORIFICE}}$$

Three common forms of presently used surge control lines are shown in FIG. 1. The one position of this line is parallel to the surge limit line (FIG. 1*a*). To minimize recirculation, the surge control line should be set as close to the surge limit line as possible. Setting the control line with a slope less than that of the limit line (FIG. 1*b*) can lead to excess recirculation at high pressures, and surge at low pressures during stopping and startup. The third method is to select a minimum safe volumetric flow, and set a vertical control line (FIG. 1*c*). This can lead to excess recirculation at low pressures, and surge at high pressures. Many systems measure flow in the discharge without correcting for suction conditions This gives maximum recirculation with minimum surge protection.

In the various surge controls, control is accomplished by opening a bypass valve around the compressor or blowing off gas to atmosphere to maintain minimum flow through the compressor. Since bypassing or blowing off gas wastes power, it is desirable to determine surge flow as accurately as possible to avoid bypassing gas unnecessarily while maintaining safe operation. However, determining surge flow is often not a simple matter, but a complex one. Surge flow for a compressor is not a fixed quantity, but is related to other variables. Where other variables substantially affect surge flow, they must be measured and included in the surge system. However, present surge systems control surge only as a function of surge control line and make no provisions for anticipatory action from a controlled variable by way of a feed forward signal of such variable.

SUMMARY OF THE INVENTION

The present invention solves the problems associated with prior art surge controls as well as others by providing a surge control system for a compressor which will anticipate a surge condition in advance of the normal surge control line and will initiate anti-surge action prior to that initiated by the surge control line.

To accomplish this, a feed forward control signal from a controlled variable other than the one used to establish the surge control line is utilized to establish a second surge control line offset from the main surge control line which will initiate anti-surge protection in advance of the main surge control line. This secondary surge control line will provide a variably offset control point from the main surge control line which will depend on the variation of the controlled variable. Thus a large change in the controlled variable will provide a larger offset than a small change and will give more advanced warning of an oncoming surge.

In view of the foregoing, it will thus be seen that one object of the present invention is to provide a surge control system having an advanced warning capability of an oncoming surge condition.

Another aspect of the present invention is to provide a surge control system having more advance warning for larger anticipated surge conditions.

These and other aspects of the present invention will become apparent after consideration of the following description of the preferred embodiment when considered with the drawings.

DESCRIPTION OF THE PREFERRED EMBODIMENT

Figures 2, 4:
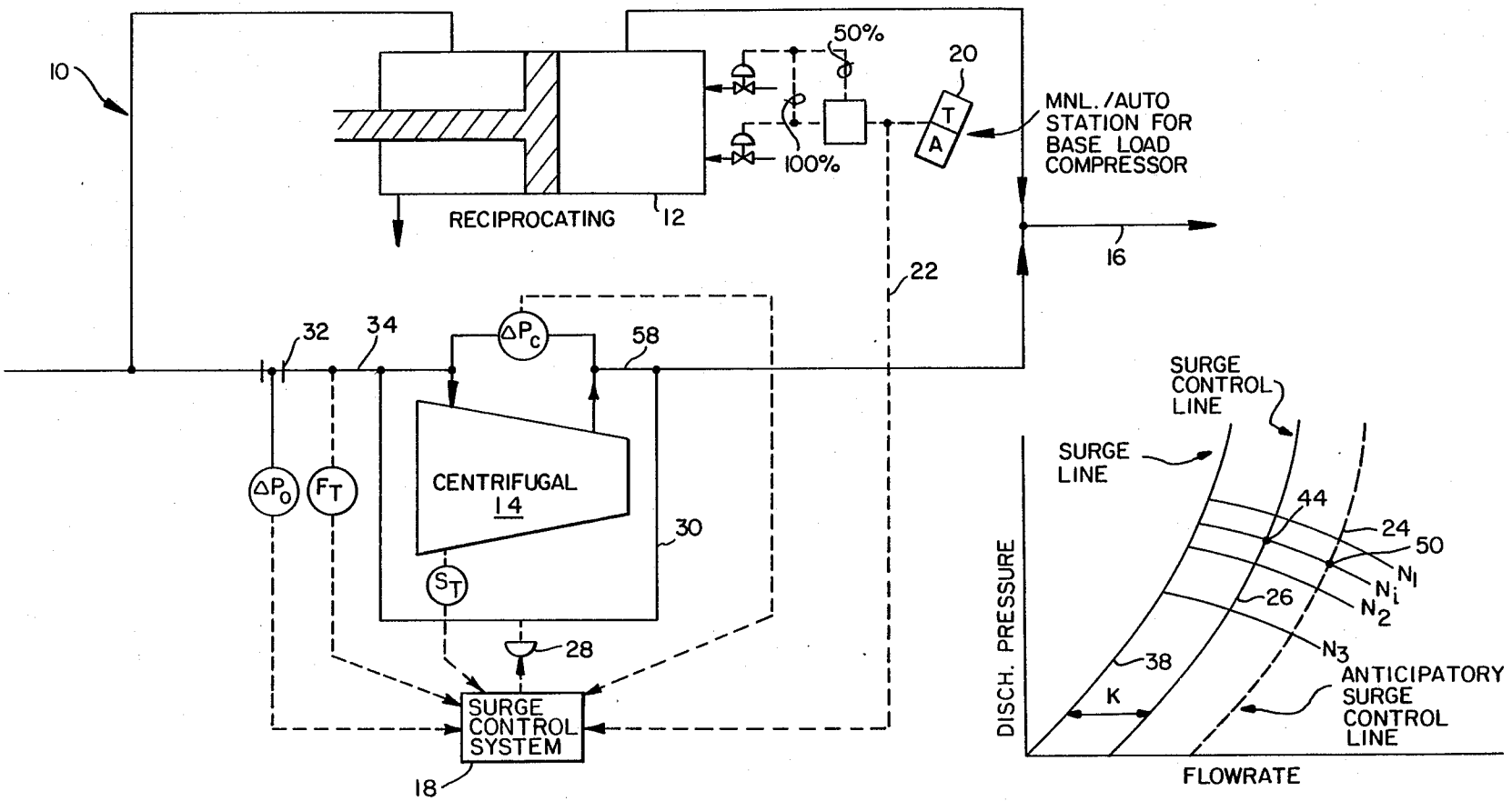
FIG. 2 is a schematic of a reciprocating and centrifugal compressors using the surge control system of the present invention.
FIG. 4 is a curve of compressor discharge pressure vs flow rate showing the relationship of the anticipatory surge control line of the present invention to the known compressor surge control lines.

Referring now to the drawings where the showings are to depict a preferred embodiment of the invention but not limit the invention thereto, FIG. 2 shows a parallel compressor system 10 having a reciprocating compressor 12 parallel connected to a centrifugal compressor 14 used to provide an output pressure at output line 16. The reciprocating compressor 12 acts as the base load machine, which can operate normally in one of two different capacities; 50% and 100% of its output pressure. This change of capacity from 100% to 50% that initiates the surge condition in compressor 14 and forms the basis of the advance warning system for the surge control system 18.

The centrifugal compressor 14 acts as a booster in the parallel arrangement, and because its a dynamic machine (vs positive displacement like the reciprocating compressor 12) it has the potential of surging because of the decrease in flow.

As the command from the MNL./AUTO station 20 decreases the demand from the reciprocating compressor 12 from 100% to 50% an incipient surge condition is produced.

This potential surge condition is provided as an input along line 22 to the surge control system 18 which, as may be best seen in FIG. 4, establishes an offset anticipatory surge control line 24 offset from the usual surge control line 26 by a bias signal generated at the station 20. Thus control of the bypass valve 28 allowing the bypass of flow across the centrifugal compressor along line 30 is initiated by the surge control system 18 prior to the surge being initiated across the centrifugal compressor 14.

Figure 1A:
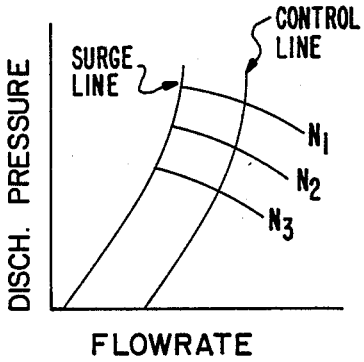
FIG. 1A PRIOR ART
FIGS. 1*a*, 1*b*, and 1*c* are a series of three curves showing prior art surge control lines.
Figure 1B:
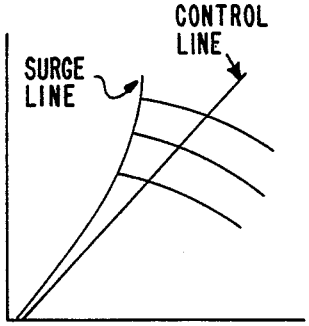
FIG. 1B PRIOR ART
Figure 1C:
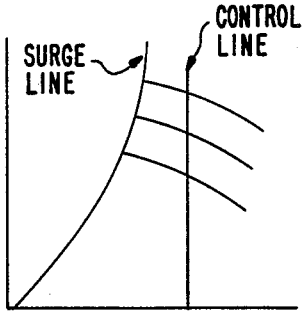
FIG. 1C PRIOR ART
Figure 3:
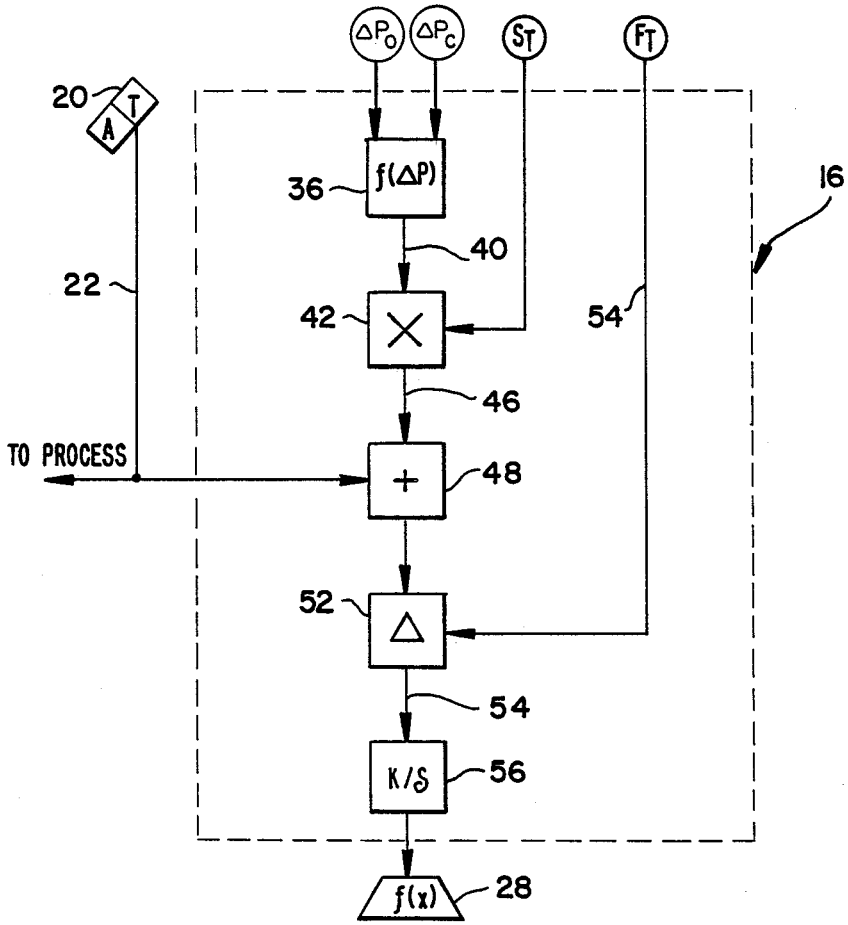
FIG. 3 is a schematic of the surge control system of FIG. 2.

With particular reference to FIGS. 3 and 4, the surge control system 18 is schematically depicted in SAMA Standard RC22-11-1966 notation with the symbols applicable to mechanical, pneumatic, or electronic control systems.

The measured variable $\Delta P_o$ and $\Delta P_c$ represent respectively the pressure differentials across an orifice 32 in an inlet line 34 of the centrifugal compressor 14 and the differential pressure across the centrifugal compressor. These measured variable are inputed into a function generator 36 which develops an output at line 40 representative of the surge control line 26 which is substantially parallel to the compressor surge line 38 and a predetermined distance K to the right of the surge line 38.

A comparison station 42 compares the surge control line developed at line 40 with the measured speed $S_T$ of the centrifugal compressor 14 thus locating the intersection 44 of a particular compressor rotation speed point $N_i$ and the surge control line 26.

This intersection point 44 is transmitted along line 46 to an adding station 48 where the anticipatory surge signal is added from line 22. This anticipatory signal is from a process variable; namely, a manual or automatic demand variation on the base load, which will cause the surge condition. Clearly the greater the signal from this process variable the greater the additive signal to the summing station 48 and the greater the offset of the anticipatory surge control line 24 from the main surge control line 26. Thus, the end result of the summing station 48 is to move the point 44 to a point 50 on the line 24.

This point 50 defines a certain compressor 14 flow rate which is compared in a difference station 52 with an actual measured compressor flow rate $F_T$ supplied along line 54 to the difference station 52. This adds a cascaded control to the surge control system 16 by providing a measured secondary variable to the feed forward anticipatory variable thus providing better performance by coupling stability with fast response and rapid compensation for process disturbances.

The output of the difference station 52 is provided along line 55 to a proportional and integral action controller 56 having a predetermined set point which will then control the final control element 28; namely, the valve controlling the amount of bypass in the line 30 to stop the surge condition by allowing the starved compressor 14 inlet 34 to utilize compressor 14 outlet fluid from line 58.

The proportional plus integral controller has an antiwindup feature. The antiwindup feature is necessary due to the nature of the proportional and integral functions. Normally, the compressor 14 operates in an area some distance from the surge control line 26, resulting in an offset between the measurement and the set point of the controller. As a result, the output signal winds up to its high or low limit.

Antiwindup adjusts the integral loading to shift the proportional band to the same side of the control line that the measurement is on when the controller reaches its output limit. Then, if the control line is approached rapidly, the measurement enters the proportional band and control starts before the valve reaches the control line. Therefore, overshoot is eliminated.

Derivative control is not used, because it can open the anti-surge valve far from the surge line and can cause system oscillations. Rapid oscillations in flow, even in the safe operating zone, can cause the valve to open because of the characteristics of the derivative response.

As soon as the controller 56 sees a deviation in set point and process variable, it will commence to control the valve 28 open to offset an incipient surge condition. This is the normal mode of control. Because of the anticipatory feed forward signal along line 22 to the summing station 48 this control of the surge condition will occur before the compressor 14 begins to see the effects and large or small surge causing conditions are easily taken care of by providing earlier anticipation for larger surge conditions.

Certain modifications and improvements have been deleted herein for the sake of conciseness and readability but are properly within the scope of the following claims.

We claim:

1. A method of controlling surge in a centrifugal compressor having a predetermined surge condition line and providing a combined output with a base load means comprising the steps of:

establishing a main surge control line offset from the centrifugal compressor surge condition line according to a function of pressure differentials across the centrifugal compressor and across an orifice in the inlet line of the centrifugal compressor;

establishing a feed forward control signal which is a function of a variable associated with the base load means which may cause the surge condition in the centrifugal compressor; and establishing an anticipatory surge control line offset from the main surge control line as a function of the established main surge control line and the established feed forward control signal.

2. A method as set forth in claim 1, wherein the main surge control line is established parallel to the surge condition line and offset a predetermined amount therefrom.

3. A method as set forth in claim 2, wherein the anticipatory surge control line is offset from the main surge control line by an amount proportional to the magnitude of the established feed forward control signal.

* * * * *